US007715581B2

(12) United States Patent
Schanz

(10) Patent No.: US 7,715,581 B2
(45) Date of Patent: May 11, 2010

(54) CONCHA/OPEN CANAL HEARING AID APPARATUS AND METHOD

(76) Inventor: Richard W. Schanz, 1120 Wesley Powell Dr., St. George, UT (US) 84790

( * ) Notice: Subject to any disclaimer, the term of this patent is extended or adjusted under 35 U.S.C. 154(b) by 0 days.

(21) Appl. No.: 12/459,880

(22) Filed: Jul. 9, 2009

(65) Prior Publication Data

US 2009/0290735 A1 Nov. 26, 2009

Related U.S. Application Data

(63) Continuation-in-part of application No. 11/520,990, filed on Sep. 14, 2006, now abandoned.

(60) Provisional application No. 60/722,621, filed on Oct. 3, 2005.

(51) Int. Cl.
*H04R 25/00* (2006.01)

(52) U.S. Cl. ..... 381/328; 381/330

(58) Field of Classification Search ..... 381/23.1, 381/71.6, 91, 328, 330, 375, 380, 386; 600/25
See application file for complete search history.

(56) References Cited

U.S. PATENT DOCUMENTS

| | | | | |
|---|---|---|---|---|
| 4,259,547 | A | 3/1981 | Valley et al. | |
| 5,208,867 | A | 5/1993 | Stites, III | |
| 5,327,506 | A | 7/1994 | Stites, III | |
| 5,987,146 | A | 11/1999 | Pluvinage et al. | |
| 6,181,801 | B1 * | 1/2001 | Puthuff et al. | 381/380 |
| 6,275,596 | B1 | 8/2001 | Fretz et al. | |
| 6,445,799 | B1 | 9/2002 | Taenzer et al. | |
| 6,577,740 | B1 | 6/2003 | Bordewijk | |
| 6,704,423 | B2 | 3/2004 | Anderson et al. | |
| 6,718,043 | B1 | 4/2004 | Boesen | |
| 7,139,404 | B2 | 11/2006 | Feeley et al. | |
| 7,519,193 | B2 * | 4/2009 | Fretz | 381/312 |
| 2003/0095677 | A1 | 5/2003 | Takada | |
| 2005/0078843 | A1 * | 4/2005 | Bauman | 381/312 |

* cited by examiner

*Primary Examiner*—Brian Ensey
(74) *Attorney, Agent, or Firm*—Marcus G. Theodore

(57) ABSTRACT

An improved hearing aid and method that employs a combination microphone/speaker, sized to have the microphone inserted within the concha bowl of the outer ear and the speaker is inserted within which the opening of the ear canal such that it does not obstruct the same for more natural hearing.

10 Claims, 3 Drawing Sheets

CONCHA/OPEN CANAL HEARING AID APPARATUS AND METHOD

RELATED APPLICATIONS

This application is a continuation-in-part of the formal patent application entitled "Hearing Aid Apparatus and Method, Ser. No. 11/520,990, filed Sep. 14, 2006, now abandoned which is dependent upon provisional patent application entitled "Hearing Aid Apparatus and Method" filed Oct. 3, 2005, Ser. No. 60/722,621.

BACKGROUND OF THE INVENTION

1. Field of Invention

The present invention relates to hearing aids. In particular, it relates to an improved hearing aid and method that employs a combination microphone/speaker, inserted within the opening of the ear canal and sized not to obstruct the same, and the microphone situated in the bowl of the concha.

2. State of the Art

Various hearing aids and earpiece devices are known in the art. Taenzer et al, U.S. Pat. No. 6,445,799B1 issued Sep. 3, 2002 provides a noise cancellation earpiece with an ear canal tube sized for positioning in an ear canal so that the ear canal is at least partially open for directly receiving ambient sounds. It is designed to send an inverse noise signal into the ear canal thereby substantially canceling the ambient noise in the ear canal. Takada, U.S. Publication No. 2003/0095677A1 published May 22, 2003 discloses a hearing aid adapted to primarily listed to a desired sound when a hearing impaired person makes conversation to others or is watching television. It employs bone conduction speakers connected with a headset yoke with a central magnetic pole surrounded by a voice coil to allow one to hear in noisy environments. Boesen, U.S. Pat. No. 6,718,043B1 issued Apr. 6, 2004 discloses a voice sound transmitting apparatus and system with a voice sound transmitting and receiving unit having an earpiece that is adapted for insertion into the external auditory canal of a user. The voice sound-transmitting unit includes a sensor, which may be a bone conduction sensor an air conduction sensor, or both. Prior to transmission, an additional processing modification or formatting of sensor output may be done. Stites, III, U.S. Pat. No. 5,208,867 issued May 4, 1993 discloses a voice transmission system and method for high ambient noise conditions employing an earpiece that fills the entire external auditory canal of a user. Stites, III, U.S. Pat. No. 5,327,506 issued Jun. 5, 1994 discloses another voice transmission system and method for high ambient noise conditions employing a similar type of earpiece that fills the entire external auditory canal of a user. Pluvinage et al, U.S. Pat. No. 5,987,146 issued Nov. 16, 1999 discloses an ear canal microphone providing an open ear canal hearing aid system. It has a plurality of ear canal tubes sized for positioning in an ear canal so that the ear canal is at least partially open for directly receiving ambient sounds. Fretz et al, U.S. Pat. No. 6,275,596B1 issued Aug. 14, 2001 discloses another open ear canal hearing aid system with the speaker positioned in the ear canal leaving it partially open. Anderson et al, U.S. Pat. No. 6,704,423B2 issued Mar. 9, 2004 discloses a hearing aid assembly having a directional microphone aligned in a forward direction mounted externally to a hearing aid body, which may have an in-the-canal or completely-in-the-canal mounting. Bauman, US Publication No. 2005/0078843 published Apr. 14, 2005 discloses a hearing aid system with a receiver sized to fit within the ear canal in an open-ear configuration. Puthuff, et al., U.S. Pat. No. 6,181,801 issued Jan. 30, 2001 discloses a wired open ear canal earpiece with a combined microphone/speaker inserted into the ear canal with a plurality of wires, which obstructs the ear canal. Feeley et al., U.S. Pat. No. 7,139,404 issued Nov. 21, 2006 discloses a BTE/CIC Auditory Device and modular connector system disclosing an interchangeable transmission lines.

Cited for general interest is the Bordewijk, U.S. Pat. No. 6,577,740B1 issued Jun. 10, 2003 disclosing a hearing aid for placement in an ear including a carrier, an enclosure, a microphone, a battery and a speaker inserted within the ear canal to totally obstruct the same. Valley et al, U.S. Pat. No. 4,259,547 issued Mar. 31, 1981 discloses a hearing aid with a dual pickup for use in a high noise environment.

None of the above references provides a hearing aid with a combination microphone/speaker arrangement positioned within the concha/ear canal, which provides an open ear canal hearing aid system for use with a variety of battery powered amplification hearing aid devices.

SUMMARY OF THE INVENTION

The present invention comprises a method and hearing aid apparatus employing a universal combination microphone/speaker operably associated via a transmission line with a behind the ear hearing aid amplifier and power source to position said combination microphone/speaker with the microphone in the concha bowl, and the speaker in the ear canal. The transmission line is connected to a support with a circuit leading to the combination microphone/speaker to position the combination microphone/speaker within the center of the exterior ear canal. A positioning wire is attached to the combination microphone/speaker adapted to be bent to fit within the exterior bowl of the ear and assist in holding the combination microphone/speaker within the ear canal. Thus positioned, the combination microphone/speaker takes advantage of the sound collecting properties of the exterior ear to funnel and capture sound to direct it to the microphone of the combination microphone/speaker. This combination microphone/speaker is axially aligned and structured such that when placed within the ear canal the microphone is directed toward the exterior of the ear and the speaker is located within the ear canal to direct amplified sound therein. Preferably the speaker includes a wax cap to prevent obstruction.

The combination microphone/speaker is sized to only partially obstruct the ear canal when inserted to reduce wind noise and produce a more natural sound. The open ear canal allows for minimal amplification and avoids an echo chamber sound. It also avoids the plugged up feeling caused by other hearing aids, which fully obstruct the ear canal.

The bendable support with circuitry means is generally fitted in one visit to an audiologist so that it is placed within the antiragus to hold the combination microphone/speaker in position within the external auditory canal of the ear. It is then connected to the behind the ear hearing aid sound processor and amplifier and power source via a plug socket system.

The transmission line has a three or four prong connector to plug into the behind the ear hearing aid sound processor, which includes an on-off switch to conserve the life of the battery when not in use. The on-off switch is also employed to shut off the device when a user takes a telephone call. By employing different prong connectors, the combination microphone/speaker may be used with different model behind the ear hearing aid sound processors and amplifiers.

In operation, after the combination microphone/speaker is positioned within the ear canal, the microphone picks up the sound as it is funneled into the ear in a natural manner. The microphone signals are then transmitted to the behind the ear sound processor for processing via one of a two channel transmission line. The sound processor then translates and amplifies the microphone signals, and sends them back to the speaker located in the ear canal via the second channel of the transmission line to amplify the sound entering the ear canal.

The present invention is therefore particularly adapted to provide an easily fittable universal combination microphone/speaker system within an unobstructed ear canal to provide more nature sound pick up and transmission.

DETAILED DESCRIPTION OF THE INVENTION

Figure 1:
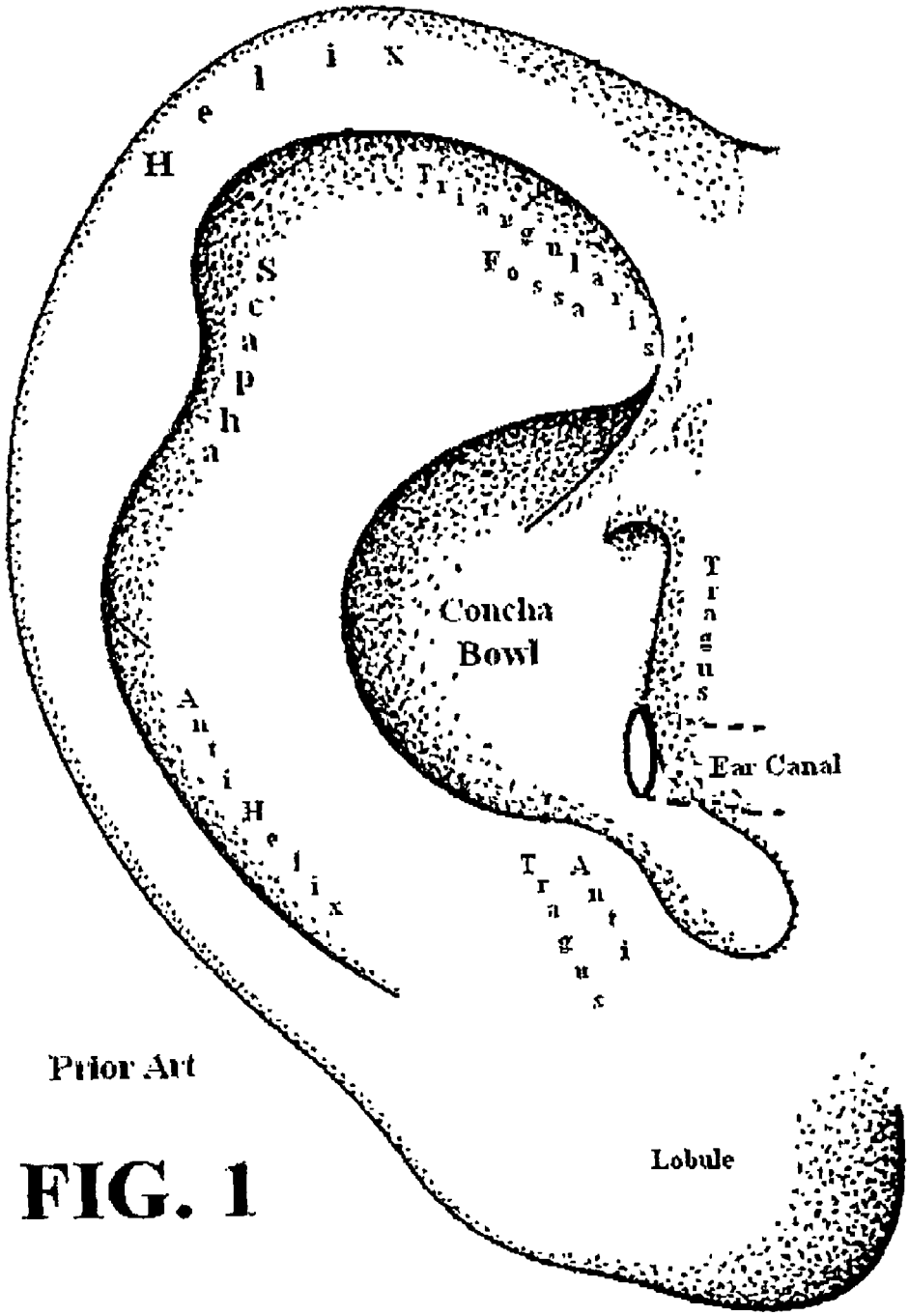
Prior Art FIG. 1
FIG. 1 is a side view of the outer ear.
Figure 2:
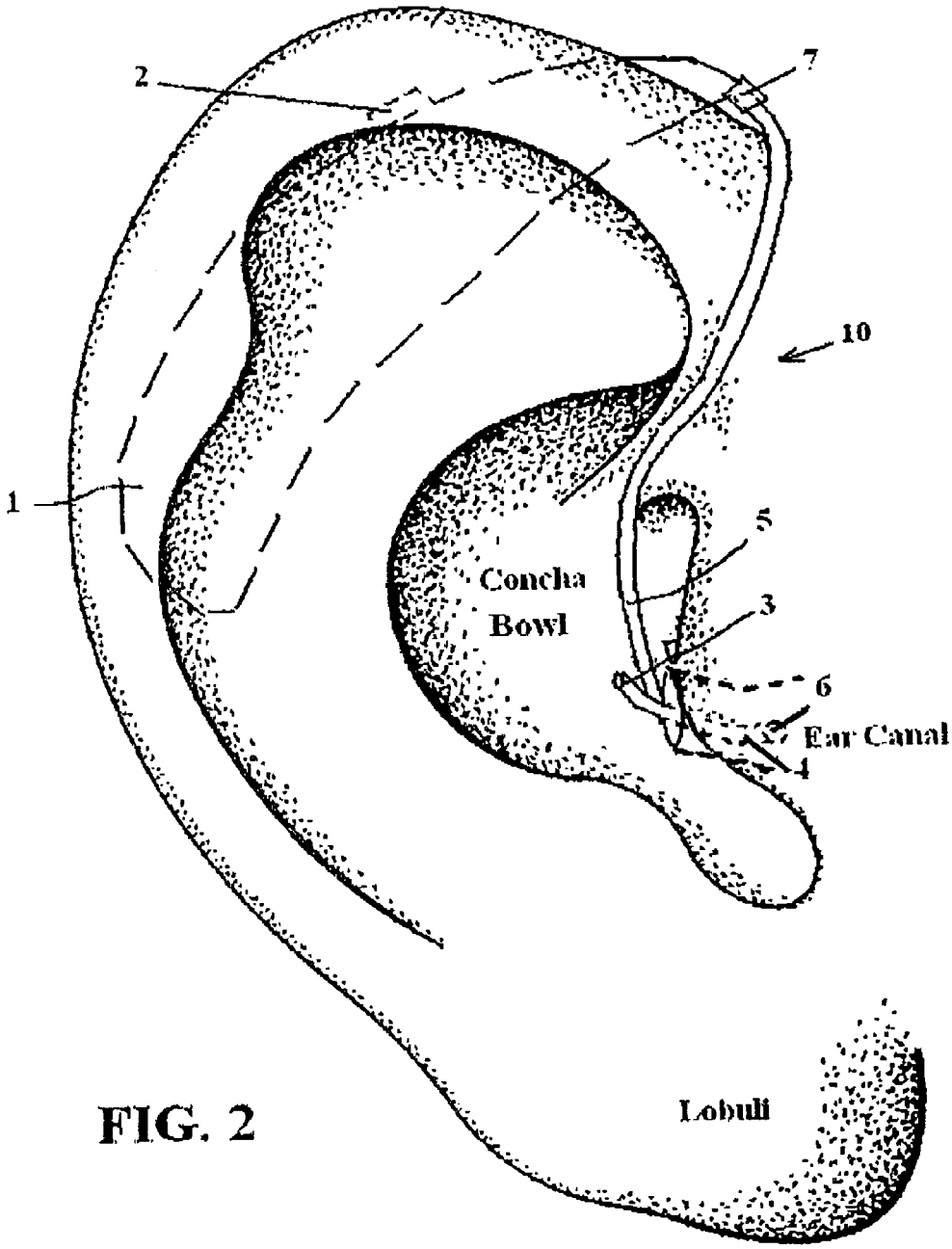
FIG. 2 is a side view of a preferred embodiment of the invention positioned on an ear.
Figure 3:
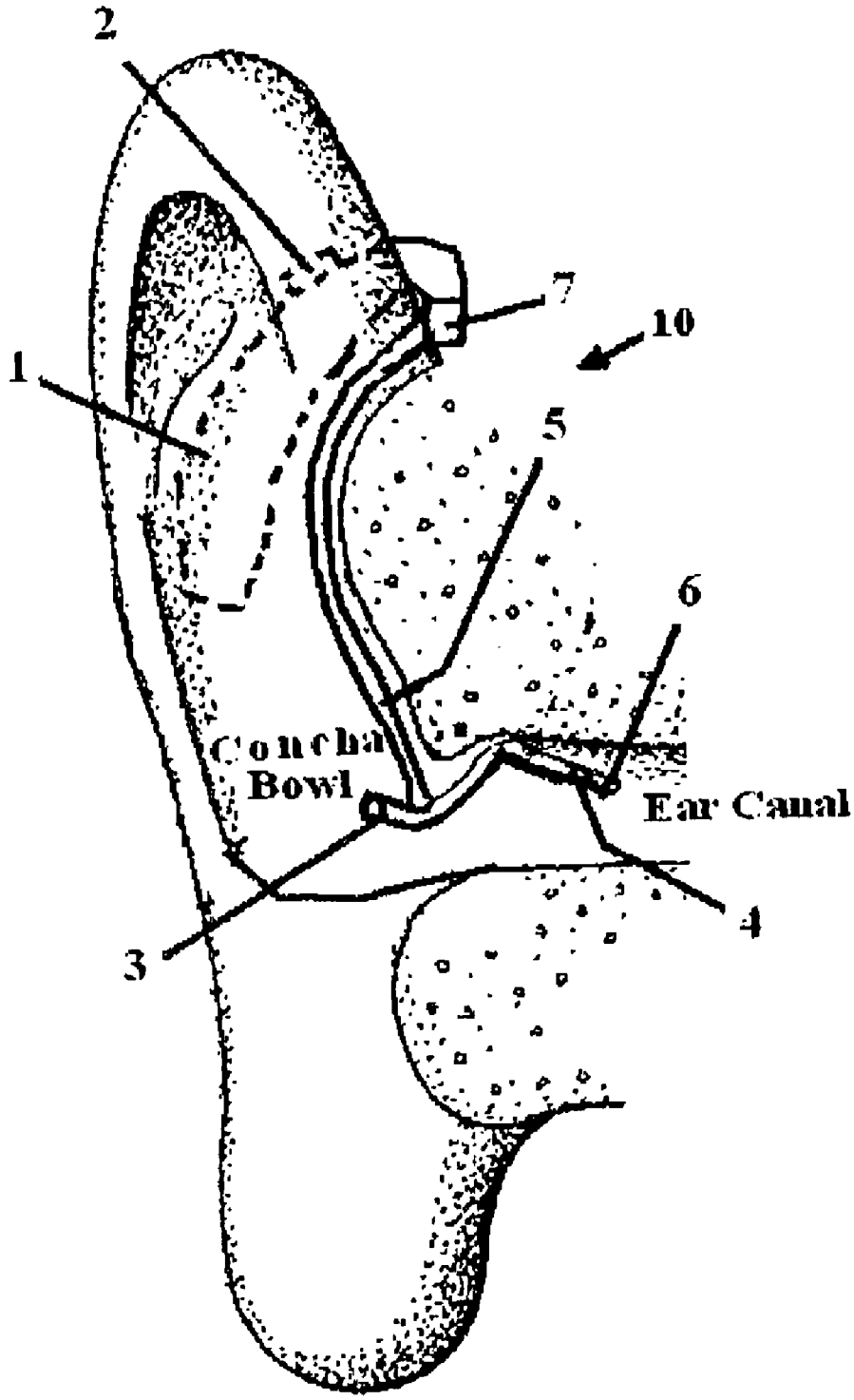
FIG. 3 is a front view of the embodiment shown in FIG. 1.

FIG. 1 is a side view of the outer ear showing its anatomical components. The concha/ear canal hearing aid 10 is shown in the attached drawings. FIGS. 2 and 3 are front and side views of a preferred embodiment of the invention positioned on a wearer's right ear. The invention comprises a sound processor 1 with a battery (not shown) and preferably includes an on/off switch 2 to selectively activate the same. A combination microphone/speaker 3, 4 is operably associated with the sound processor 1 via a sound wire 5, which has sufficient rigidity to position the combination microphone/speaker 3,4 to properly orient the same.

The microphone 3 is positioned within the concha of the exterior ear to pickup sound focused by the sound funneling structure of the outer ear. The microphone 3 picks up the sound, changes it into electronic impulses, which are sent to the sound processor 1.

The sound wire 5 leading from the sound processor 1 to the microphone/speaker 3, 4 thus acts as a bendable support to position the speaker 4 directed toward the inner ear. The speaker 4 and sound wire 5 are sized and positioned to fit within and partially obstruct the interior ear canal to allow air and natural sound to flow there through. The natural sound is combined with amplified sound to minimize echoes and provide more natural sound pick up and transmission.

Filters (not shown) may be associated with the sound processor amplifier 1 to compensate for feedback signals, static, and other interference.

The exterior of the sound processor amplifier 1 includes a power switch 2 associated with the battery to turn the hearing aid on in one mode, and off in another mode to conserve battery life and facilitate telephoning. It also includes a volume control (not shown) so the wearer has complete control over the amount of amplification for maximum listening comfort.

Preferably, the hearing aid speaker 4 includes a wax cap 6 shown in FIG. 3 to prevent obstruction.

The invention thus provides a new in the concha bowl/ear channel hearing aid 10, which the wearer to hear more natural sounds.

The combination microphone/speaker comprises a long thin approximately $\frac{1}{8}^{th}$ inch in diameter combination microphone/speaker 3, 4 with a microphone 3 at one end and a speaker 4 with wax cap 6 at the other end as shown in FIG. 3. The long thin microphone/speaker 3, 4 unit is connected to a behind the ear sound processor 1 with a vinyl coated sound wire 5 so that the speaker protrudes into the ear canal about ½ inch. The sound wire 5 is firm yet bendable to fit the contours of the ear.

In this position, the microphone 3 picks up the funneled sound, as described above. The microphone 3 signals are then transmitted to the processor 1 via the sound wire 5 for processing. The processor 1 then transmits the amplified signal via the sound wire 5 to the speaker 4 to direct the amplified sound into the inner ear. In the preferred embodiment, the microphone 3, as well as the speaker 4, is suspended in the center of the ear canal, without touching the ear canal wall. This is possible because the sound wire 5 and the combination microphone/speaker have such a small diameters.

The sound wire 5 is made of vinyl coated wire, which is firm yet bendable to fit different contours of the outer ear so that it follows the contours of the outer ear. It thus is rust proof and can be readily fitted without the need for multiple visits to an ear specialist.

The diameter of the combination microphone/speaker 3, 4 is sized to be inserted within the ear canal without plugging said ear canal. The unobstructed positioning of this combination microphone/speaker 3, 4 within the ear canal allows air circulation, and requires minimal amplification. It also reduces wind noise to produce a more natural sound. It is also virtually invisible and prevents echo chamber sounds.

Three or four prong connector ends 7 of the sound wire 5 may be adapted to interconnect to different manufacturers' sound processors 18 via either a three or four prong connector system.

Thus, the employment of the combination microphone/speaker 3, 4 with a sound processor 1 provides a more natural hearing system and method.

The size of the universal combination microphone/speaker 3, 4 is preferably structured to come in three standard lengths to accommodate the different sized ears and ear canals. Thus inventory sizes are reduced as these three lengths accommodate almost all different ear sizes.

The above description and specification should not be construed as limiting the scope of the appended claims. The claims themselves recite those features deemed essential for the invention.

I claim:

1. An in the concha bowl/ear canal hearing aid comprising:

a. a sound processor with an amplifier and power source sized and structured to fit behind the outer ear and amplify electronic impulses from a microphone, b. a combination microphone/speaker having:

i. a base with a first end structured to be located within the concha bowl of the exterior outer ear and an opposite second end structured to be located within the exterior ear canal, ii. microphone attached to the first end to pick up sound gathered by the concha bowl of the exterior ear and generate electronic impulses in response to sound, iii. a speaker attached to the second end to transmit sound into the exterior ear canal in response to amplified electronic impulses transmitted by the sound processor; the base, microphone, and speaker sized to fit within and partially obstruct the concha bowl and exterior ear canal to allow air to flow there through to minimize echoes and provide more natural sound pick up and transmission, c. a bendable support with one end attached to the sound processor and the other end attached to the base to position the microphone within the concha bowl of the ear to pickup sound focused by the exterior sound funneling of the outer ear, and position the speaker within the exterior ear canal pointed toward the inner ear to direct amplified sound therein, and d. electronic transmission means associated with the bendable support with one end operably associated with the microphone/speaker and the other end associated with the behind the sound processor with amplifier and power source to selectively activate the microphone and speaker to combine external sound entering the ear exterior canal with amplified sound from the speaker.

2. An in the concha bowl/ear canal hearing aid according to claim 1, wherein the bendable support and electronic means comprise wire leads attached to the sound processor.

3. An in the concha bowl/ear canal hearing aid according to claim 1, including filters associated with the sound processor and amplifier to compensate for feedback signals and other interference.

4. An in the concha bowl/ear canal hearing aid according to claim 1, including a power switch associated with the sound processor and battery to turn the hearing aid on in one mode, and off in another mode.

5. An in the concha bowl/ear canal hearing aid according to claim 1, wherein the speaker includes a wax cap to prevent obstruction.

6. A method of using an in the concha bowl/ear canal hearing aid comprising:

a. placing behind the outer ear a sound processor with an amplifier and power source sized and structured to amplify electronic impulses from a microphone, b. securing with a bendable support a combination microphone/speaker having:

i. a base with a first end structured to be located within the concha bowl of the exterior outer ear and an opposite second end structured to be located within the exterior ear canal, ii. a microphone attached to the first end to pick up sound gathered by the concha bowl of the exterior ear and generate electronic impulses in response to sound, iii. a speaker attached to the second end to transmit sound into the exterior ear canal in response to amplified electronic impulses transmitted by the sound processor; the base, microphone, and speaker positioned and sized to fit within and partially obstruct the concha bowl and exterior ear canal to enable the microphone to pick up sound focused by the exterior sound funneling of the outer ear, and position the speaker within the ear canal pointed toward the inner ear to direct amplified sound thereto while allowing air to flow there through to minimize echoes and provide more natural sound pick up and transmission, c. associating electronic transmission means with the bendable support having one end operably associated with the microphone/speaker and the other end associated with the sound processor, amplifier, and power source to selectively activate the microphone and speaker, and d. selectively activating the in the concha bowl/ear canal hearing aid to combine external sound entering the ear canal with amplified sound from the speaker.

7. A method of using an in the concha bowl/ear canal hearing aid according to claim 6, wherein the bendable support is structured to be generally fitted in one visit to an audiologist so that it is placed within the bowl to hold the speaker in position within the external auditory canal of the ear.

8. A method of using an in the concha bowl/ear canal hearing aid according to claim 6, wherein the hearing aid includes filters associated with the sound processor and amplifier to compensate for feedback signals and other interference.

9. A method of using an in the concha bowl/ear canal hearing aid according to claim 8, wherein the filters are selectively adjusted to provide the desired combination of external sound entering the ear canal with amplified sound from the speaker.

10. A method of using an in the concha bowl/ear canal hearing aid according to claim 6, wherein the bendable support and transmission means is a transmission line with connector ends.

* * * * *